US010844718B2

(12) United States Patent
Schneider

(10) Patent No.: US 10,844,718 B2
(45) Date of Patent: Nov. 24, 2020

(54) FREE PISTON APPARATUS

(71) Applicant: Deutsches Zentrum für Luft- und Raumfahrt e.V., Cologne (DE)

(72) Inventor: Stephan Schneider, Stuttgart (DE)

(73) Assignee: DEUTSCHES ZENTRUM FÜR LUFT-UND RAUMFAHRT E.V., Cologne (DE)

( * ) Notice: Subject to any disclaimer, the term of this patent is extended or adjusted under 35 U.S.C. 154(b) by 0 days.

(21) Appl. No.: 16/192,266

(22) Filed: Nov. 15, 2018

(65) Prior Publication Data

US 2019/0085693 A1 Mar. 21, 2019

Related U.S. Application Data

(63) Continuation of application No. PCT/EP2017/061516, filed on May 12, 2017.

(30) Foreign Application Priority Data

May 17, 2016 (DE) ..... 10 2016 109 046

(51) Int. Cl.
*F01B 11/00* (2006.01)
*F01P 3/02* (2006.01)
(Continued)

(52) U.S. Cl.
CPC ..... *F01B 11/007* (2013.01); *F01B 7/02* (2013.01); *F01B 11/02* (2013.01); *F01P 3/00* (2013.01);
(Continued)

(58) Field of Classification Search
CPC ..... F01P 3/00; F01P 3/02; F02B 71/00; F02B 71/04; F02B 75/282; F02B 63/041; F01B 11/007; F01B 7/02; F01B 11/02
See application file for complete search history.

(56) References Cited

U.S. PATENT DOCUMENTS 3,411,289 A 11/1968 Antonsen et al.
4,048,970 A 9/1977 Fitzgerald
(Continued)

FOREIGN PATENT DOCUMENTS

AU 6302199 A 6/2001
AU 4205001 A 12/2001
(Continued)

OTHER PUBLICATIONS

International Preliminary Report on Patentability for Application No. PCT/EP2017/061516, dated Nov. 20, 2018—6 pages.
(Continued)

*Primary Examiner* — Syed O Hasan

(57) ABSTRACT

A free piston apparatus includes a piston receptacle in which a piston device having a piston is reciprocable along an axis. The piston receptacle includes or forms a chamber delimited by a wall arrangement forming an inlet opening and an outlet opening. A cooling device is arranged on the piston receptacle for cooling the wall arrangement. The cooling device includes or forms a cooling channel arranged radially outside on the wall arrangement. The cooling channel has first and second cooling regions axially on opposing sides of the outlet opening. The piston receptacle includes or forms an outlet chamber, arranged outside on the wall arrangement, for exhaust gas exiting via the outlet opening. The cooling channel has a third cooling region which flow-connects the first cooling region and the second cooling region along the outlet chamber and is positioned at least in sections radially outside of the outlet chamber.

28 Claims, 6 Drawing Sheets

(51) Int. Cl.

| | |
|---|---|
| ***F01B 11/02*** | (2006.01) |
| ***F02B 71/00*** | (2006.01) |
| ***F01P 3/00*** | (2006.01) |
| ***F01B 7/02*** | (2006.01) |
| ***F02B 71/04*** | (2006.01) |
| ***F02B 75/28*** | (2006.01) |
| *F02B 63/04* | (2006.01) |
| *F02B 75/02* | (2006.01) |

(52) U.S. Cl.
CPC ..... *F01P 3/02* (2013.01); *F02B 71/00* (2013.01); *F02B 71/04* (2013.01); *F02B 75/282* (2013.01); *F02B 63/041* (2013.01); *F02B 2075/025* (2013.01)

(56) References Cited

U.S. PATENT DOCUMENTS

| | | | | |
|---|---|---|---|---|
| 4,287,859 | A | 9/1981 | Noguchi et al. | |
| 5,002,020 | A | 3/1991 | Kos | |
| 5,893,343 | A | 4/1999 | Rigazzi | |
| 6,029,616 | A | 2/2000 | Mayne et al. | |
| 6,138,639 | A | 10/2000 | Hiraya et al. | |
| 6,748,907 | B2 | 6/2004 | Malmquist et al. | |
| 6,904,876 | B1 | 6/2005 | Hofbauer et al. | |
| 7,082,909 | B2 | 8/2006 | Gräf et al. | |
| 7,258,085 | B2 | 8/2007 | Niiyama et al. | |
| 8,485,147 | B2 | 7/2013 | Liu et al. | |
| 8,887,690 | B1 | 11/2014 | Sturman | |
| 2002/0134324 | A1* | 9/2002 | Wechner | F01L 11/02 123/46 R |
| 2003/0066499 | A1 | 4/2003 | Berlinger et al. | |
| 2003/0094164 | A1 | 5/2003 | Lowi et al. | |
| 2005/0109295 | A1 | 5/2005 | Kaneko et al. | |
| 2005/0274332 | A1 | 12/2005 | Lemke et al. | |
| 2006/0042575 | A1* | 3/2006 | Schmuecker | F02B 71/04 123/46 R |
| 2006/0124083 | A1 | 6/2006 | Niiyama et al. | |
| 2006/0201456 | A1* | 9/2006 | Hofbauer | F02B 1/12 123/46 R |
| 2007/0261677 | A1 | 11/2007 | Bennion | |
| 2008/0036312 | A1* | 2/2008 | Max | F02B 1/12 123/46 R |
| 2009/0101005 | A1 | 4/2009 | Pohl et al. | |
| 2012/0112468 | A1 | 5/2012 | Najt et al. | |
| 2012/0186561 | A1 | 7/2012 | Bethel et al. | |
| 2012/0266851 | A1 | 10/2012 | Hofbauer et al. | |
| 2013/0014718 | A1 | 1/2013 | Shen et al. | |
| 2013/0167798 | A1 | 7/2013 | Lawler et al. | |
| 2013/0319368 | A1* | 12/2013 | Clarke | F01L 5/06 123/294 |
| 2015/0033736 | A1 | 2/2015 | Kalebjian et al. | |
| 2015/0300241 | A1 | 10/2015 | Holland | |
| 2016/0208686 | A1 | 7/2016 | Gadda et al. | |
| 2017/0204801 | A1 | 7/2017 | Sharma et al. | |
| 2017/0248099 | A1 | 8/2017 | Wagner et al. | |

FOREIGN PATENT DOCUMENTS

| | | | |
|---|---|---|---|
| AU | 2003232496 | A1 | 11/2003 |
| AU | 2003236392 | A1 | 5/2004 |
| CH | 188403 | A | 12/1936 |
| CN | 103842634 | A | 6/2014 |
| DE | 2844309 | A1 | 10/1979 |
| DE | 3103432 | A1 | 9/1982 |
| DE | 3111419 | A1 | 10/1982 |
| DE | 3047138 | A1 | 11/1982 |
| DE | 3438219 | A1 | 4/1986 |
| DE | 10219549 | B4 | 3/2004 |
| DE | 10242141 | A1 | 3/2004 |
| DE | 69817998 | T2 | 5/2004 |
| DE | 102004062440 | B4 | 9/2006 |
| DE | 102005006340 | A1 | 4/2007 |
| DE | 102005056823 | A1 | 5/2007 |
| DE | 102006029532 | A1 | 12/2007 |
| DE | 102008030633 | B4 | 4/2010 |
| DE | 102008053068 | A1 | 4/2010 |
| DE | 102008053069 | A1 | 5/2010 |
| DE | 102012111067 | B3 | 2/2014 |
| EP | 1398863 | A1 | 3/2004 |
| EP | 2224580 | A2 | 9/2010 |
| GB | 889509 | | 2/1962 |
| GB | 2334385 | A | 8/1999 |
| WO | 9533921 | A1 | 12/1995 |
| WO | 9728362 | A1 | 8/1997 |
| WO | 9813593 | A1 | 4/1998 |
| WO | 0145977 | A2 | 6/2001 |
| WO | 0194752 | A1 | 12/2001 |
| WO | 03091556 | A1 | 11/2003 |
| WO | 2004025098 | A1 | 3/2004 |
| WO | 2007010186 | A1 | 1/2007 |
| WO | 2007085344 | A1 | 8/2007 |
| WO | 2007147789 | A1 | 12/2007 |
| WO | 2008028216 | A1 | 3/2008 |
| WO | 2009156257 | A1 | 12/2009 |
| WO | 2010046120 | A1 | 4/2010 |
| WO | 2010046121 | A1 | 4/2010 |
| WO | 2012158756 | A1 | 11/2012 |

OTHER PUBLICATIONS

International Search Report and Written Opinion for Application No. PCT/EP2017/061516, dated Aug. 9, 2017—7 pages.
Notice of Allowance for U.S. Appl. No. 16/192,291, dated Oct. 28, 2019, 19 pages.
Notice of Allowance for U.S. Appl. No. 16/192,301, dated Nov. 18, 2019, 13 pages.
International Search Report and Written Opinion for International Application No. PCT/EP2017/061495, dated Aug. 9, 2017—10 pages.
International Search Report and Written Opinion for International Application No. PCT/EP2017/061510, dated Aug. 10, 2017—9 pages.
International Preliminary Report on Patentability for Application No. PCT/EP2017/061522, dated Nov. 20, 2018—8 pages.
International Search Report and Written Opinion for Application No. PCT/EP2017/061522, dated Aug. 9, 2017—9 pages.
International Preliminary Report on Patentability for International Application No. PCT/EP2017/061510, dated Nov. 20, 2018, 8 pages.
Non Final Office Action for U.S. Appl. No. 16/192,301, dated May 14, 2019, 19 pages.
Non Final Office Action for U.S. Appl. No. 16/192,283, dated Feb. 6, 2020, 29 pages.

* cited by examiner

FREE PISTON APPARATUS

CROSS-REFERENCE TO RELATED APPLICATIONS

This application is a continuation of International Application No. PCT/EP2017/061516, filed May 12, 2017, and claims the benefit of priority of German Application No. 10 2016 109 046.8, filed May 17, 2016. The contents of International Application No. PCT/EP2017/061516 and German Application No. 10 2016 109 046 are incorporated by reference herein in their entireties and for all purposes.

FIELD

The present disclosure relates to a free piston apparatus, comprising a piston receptacle in which at least one piston device having a piston is arranged so as to be reciprocable along an axis, wherein the piston receptacle comprises or forms a combustion chamber delimited by a wall arrangement in which at least one inlet opening for the supply of fresh gas and, spaced apart therefrom in an axial direction, at least one outlet opening for the removal of exhaust gas are formed, wherein the free piston apparatus comprises a cooling device arranged on the piston receptacle for cooling the wall arrangement.

BACKGROUND

In a free piston apparatus of that kind, which is commonly operated in the two stroke method, the piston device oscillates back and forth in the piston receptacle. Upon the combustion of a gas-fuel-mixture in the combustion chamber, the piston is moved from a top dead center to a bottom dead center. Upon adopting the bottom dead center, the at least one inlet opening and the at least one outlet opening are opened and fresh gas is able to flow into the combustion chamber. Exhaust gas may be removed from the combustion chamber. The piston may act as a valve body with which the at least one inlet opening or the at least one outlet opening upon adopting the bottom dead center is at least partially unblocked and is blocked again upon the upward movement of the piston. The upward movement of the piston occurs under the action of a spring-back device of the free piston apparatus for the piston device. The spring-back device comprises for example a gas spring with a gas which is compressible by way of the piston device. Upon an expansion of the gas, the piston device is moved in the opposite direction for the upward movement of the piston. Alternatively or in addition, a mechanical spring-back device may be provided.

"Fresh gas" is presently to be understood as a gas or gas mixture (in particular air) for the internal combustion in the combustion chamber, wherein a fuel may also be admixed to the gas. "Fresh gas" may therefore presently also refer to a gas-fuel-mixture which may flow into the combustion chamber via the at least one entry opening. "Exhaust gas" presently refers to a combustion product of the internal combustion.

In the conventional free piston apparatus, a scavenging gradient is caused by the openings for the inlet and for the outlet, which are axially spaced apart from each other, and the combustion chamber is scavenged in axial direction (so-called uniflow scavenging) for the charge exchange. "Axial" and "radial" presently refer to the axis defined by the piston receptacle, along which the piston device is moved. "Axial" presently includes a path parallel to the axis (axially parallel).

Due to the scavenging gradient, there results a significant temperature difference in the wall arrangement on the inlet side and on the outlet side. In the region of the at least one outlet opening, the temperature may typically be about 1000° C., for example, which limits and complicates, respectively, the selection and adaptation of the materials used. In particular the undesired heating of further components of the free piston apparatus may hereby also prove to be problematic. In particular the undesired heating of an energy coupling device comprised by the free piston apparatus should hereby be mentioned, which may be limited in its functionality as a result. In the region of the wall arrangement, the conventional free piston apparatus comprises a cooling device on the piston receptacle for cooling the piston receptacle. The cooling device is able to be acted upon with a cooling medium, in particular water.

SUMMARY

An object underlying the present disclosure is to further develop a free piston apparatus of the kind stated at the outset, in which a better cooling of the piston receptacle is made possible.

In an aspect of the present disclosure, a free piston apparatus, comprises a piston receptacle in which at least one piston device having a piston is arranged so as to be reciprocable along an axis. The piston receptacle comprises or forms a combustion chamber delimited by a wall arrangement in which at least one inlet opening for the supply of fresh gas and, spaced apart therefrom in an axial direction, at least one outlet opening for the removal of exhaust gas are formed. The free piston apparatus comprises a cooling device arranged on the piston receptacle for cooling the wall arrangement. The cooling device comprises or forms a cooling channel for a cooling medium which is arranged radially outside on the wall arrangement and at least partially surrounds the same in circumferential direction of the axis. The cooling channel has a first cooling region and a second cooling region axially on opposing sides of the at least one outlet opening. The piston receptacle comprises or forms an outlet chamber, arranged outside on the wall arrangement, for exhaust gas exiting via the at least one outlet opening. The cooling channel has at least one third cooling region which extends at least partially in circumferential direction of the axis and which flow-connects the first cooling region and the second cooling region along the axial extension of the outlet chamber and is positioned at least in sections radially outside of the outlet chamber.

BRIEF DESCRIPTION OF THE DRAWINGS

The foregoing summary and the following description may be better understood in conjunction with the drawing figures, of which.

DETAILED DESCRIPTION

Figure 1:
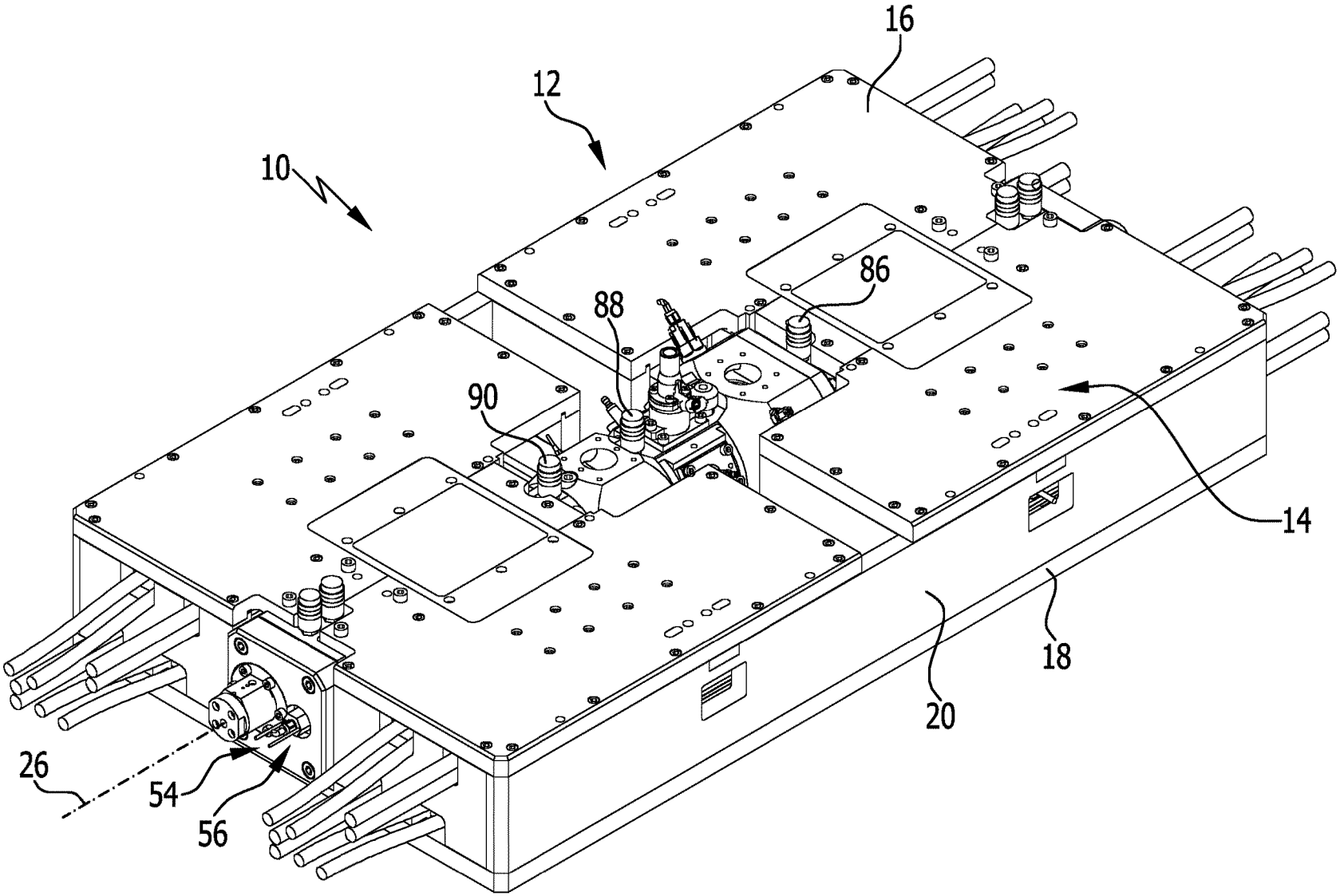
FIG. 1: shows a perspective depiction of a free piston apparatus in accordance with the present disclosure.

Although the present disclosure illustrates and describes specific embodiments, the present disclosure is not intended to be limited to the details shown. Rather, various modifications may be made in the details without departing from the present disclosure.

The present disclosure relates to a free piston apparatus, comprising a piston receptacle in which at least one piston device having a piston is arranged so as to be reciprocable along an axis, wherein the piston receptacle comprises or forms a combustion chamber delimited by a wall arrangement in which at least one inlet opening for the supply of fresh gas and, spaced apart therefrom in an axial direction, at least one outlet opening for the removal of exhaust gas are formed, wherein the free piston apparatus comprises a cooling device arranged on the piston receptacle for cooling the wall arrangement. The cooling device comprises or forms a cooling channel for a cooling medium which is arranged radially outside on the wall arrangement and at least partially surrounds the same in circumferential direction of the axis, which cooling channel has a first cooling region and a second cooling region axially on opposing sides of the at least one outlet opening. The piston receptacle comprises or forms an outlet chamber, arranged outside on the wall arrangement, for exhaust gas exiting via the at least one outlet opening, and the cooling channel has at least one third cooling region which extends at least partially in circumferential direction of the axis and which flow-connects the first cooling region and the second cooling region along the axial extension of the outlet chamber and is positioned at least in sections radially outside of the outlet chamber.

In the free piston apparatus in accordance with the present disclosure, provision is made for the cooling channel to have multiple cooling regions. A first and a second cooling region are arranged axially next to the at least one outlet opening and radially surrounding the wall arrangement at least partially. Arranged between the first cooling region and the second cooling region is an outlet chamber for exhaust gas, into which exhaust gas enters via the at least one outlet opening. For example, an outlet conduit for exhaust gas of the free piston apparatus is connected to the outlet chamber. In order to achieve an effective cooling of the piston receptacle also in the region of the outlet chamber, the at least one third cooling region is provided. The latter forms a flow connection from the first cooling region to the second cooling region along the axial extension of the outlet chamber. The at least one third cooling region is positioned radially outside of the outlet chamber and extends at least partially in circumferential direction of the axis. This offers the possibility of first collecting in the outlet chamber exhaust gas which has escaped and releasing the same via the outlet conduit, wherein simultaneously an effective cooling of the radially outside wall arrangement of the outlet chamber is achieved by way of the at least one third cooling region. The heat emission to further components of the free piston apparatus, which are arranged laterally next to the piston receptacle in the region of the at least one outlet opening, may thereby be substantially reduced. In an advantageous embodiment, this facilitates, e.g., the function of an energy coupling device positioned laterally next to the piston receptacle, which will subsequently be explained.

In an advantageous implementation of the free piston apparatus in accordance with the present disclosure, e.g., about five liters to about ten liters per minute flow through the cooling channel. The flow temperature of the cooling medium, in particular water, may be about 80° C. to about 95° C., for example.

It proves to be advantageous if the cooling channel has two third cooling regions which are arranged on the piston receptacle opposite each other with respect to the axis. This is advantageous, e.g. in an arrangement of a respective energy coupling device or a part thereof on opposing sides of the axis, in particular in the case of a flat construction of the free piston apparatus.

The at least one third cooling region advantageously has an axially running cooling channel section which is arranged radially next to an outer wall of the outlet chamber. Heat may be released to the cooling channel by way of the outer wall formed by the piston receptacle and be effectively removed by the cooling medium. The cooling channel section may be delimited radially outside by a channel wall. On the side of the channel wall opposite the cooling channel section, e.g., a receiving space for the energy coupling device is provided.

The at least one third cooling region preferably comprises axially next to the outlet chamber a cooling channel section running transverse or inclined to the axis for the flow connection to the first cooling region. For example, the cooling channel section is aligned transverse to the axis and connects the first cooling region to the aforementioned cooling channel section radially next to the outer wall of the outlet chamber.

It is favorable if the at least one third cooling region comprises axially next to the outlet chamber a cooling channel section running transverse or inclined to the axis for the flow connection to the second cooling region. In an advantageous embodiment, the cooling channel section is inclined relative to the axis and connects the aforementioned cooling channel section radially next to the outer wall of the outlet chamber to the second cooling region.

It is advantageous if the cooling channel at the at least one third cooling region is configured as a flat channel at least radially next to the outlet chamber. This may presently be understood in particular in that a wide side of the flat channel runs in circumferential direction of the axis or is aligned tangential to an outer wall of the outlet chamber. Cooling medium preferably flows axially through the flat channel.

In an advantageous implementation, it is favorable if a width of the cooling channel at the at least one third cooling region is at least approximately equal to the diameter of the combustion chamber at least radially next to the outlet chamber. For example, a plurality of outlet openings is provided, which are distributed over the circumference of the wall arrangement. The outlet chamber may surround the wall arrangement in circumferential direction. If the cooling channel at the least one third cooling region is at least so wide that it corresponds to the diameter of the combustion chamber, then as a result, an effective cooling of the outlet chamber surrounding the wall arrangement may be achieved. "Width" presently refers to a cross section perpendicular to the axis, wherein in particular as mentioned above, a flat channel may be provided which is aligned in circumferential direction of the axis or tangential.

The at least one third cooling region may preferably cover an angle range of about 45° to about 60° in circumferential direction of the axis, at least radially next to the outlet chamber.

Provision may advantageously be made for the cooling channel at the first cooling region and/or at the second cooling region to be an annular channel. "Annular channel" presently describes a channel closed in itself in circumferential direction of the axis, wherein a circular ring shape is not necessary. The annular channel may allow through-flow axially, in circumferential direction of the axis or oblique to the axis.

The cooling channel may entirely or partially form a cooling jacket for the wall arrangement by configuring at least one cooling region as an annular channel.

Provision may also be made for the at least one third cooling region to be configured as an annular channel.

Formed in the wall arrangement is advantageously a plurality of outlet openings via which the combustion chamber opens into the outlet chamber, wherein adjacent outlet openings in circumferential direction of the axis are separated from each other by way of in each case one wall segment of the wall arrangement, wherein the cooling channel comprises or forms cooling channel sections at least in a part of the wall segments, which cooling channel sections flow-connect the first cooling region to the second cooling region. As already mentioned, the combustion chamber may open into the outlet chamber via the plurality of outlet openings, from which outlet chamber exhaust gas may be removed, e.g., via at least one outlet conduit connected thereto. The at least one third cooling region enables an effective cooling radially outside on an outer wall of the outlet chamber. In addition, in the present advantageous embodiment, cooling channel sections are provided which flow-connect the first cooling region to the second cooling region. The cooling channel sections run through wall segments between the outlet openings which are particularly intensely heated by the hot exhaust gas. This allows for cooling the wall arrangement even better.

The cooling channel sections run axially, for example.

At least one cooling channel section may run in each wall segment.

The outlet chamber may, as mentioned, entirely or substantially entirely surround the wall arrangement in circumferential direction.

In an advantageous embodiment, the first cooling region is arranged on the cooling channel on the upstream side and is arranged on a side of the at least one outlet opening remote from the at least one inlet opening, and the second cooling region is favorably arranged on a side of the at least one outlet opening facing the at least one inlet opening, wherein the cooling medium flows through the first cooling region and the at least one third cooling region to the second cooling region. This offers the possibility of cooling the wall arrangement with the cooling medium first at the particularly hot regions. The feed of the cooling device is arranged axially on the side of the outlet opening remote from the inlet opening. From there, the cooling medium flows through the first cooling region, then the at least one third cooling region, and then the second cooling region. In the region of the second cooling region, the wall arrangement is less hot due to the uniflow scavenging of the combustion chamber. As a result, by way of the proposed cooling, overall a better heat removal from the piston receptacle is made possible as compared to flow through the cooling channel in the opposite direction.

It is favorable if the piston receptacle has a housing and a piston bushing which is accommodated thereby and forms the wall arrangement, wherein the first cooling region, the second cooling region, and/or the outlet chamber are formed radially between the piston bushing and the housing. The piston bushing, for example a cylinder bushing, enables a quiet and reliable cycle of the piston. The at least one inlet opening and the at least one outlet opening are formed in the piston bushing. The cooling channel runs between the piston bushing and the housing at least at the first cooling region and/or at the second cooling region, whereby the wall arrangement may be reliably cooled. The outlet chamber is preferably formed radially between the piston bushing and the housing. Axial face walls of the outlet chamber may be formed by the piston bushing and/or by the housing.

It is favorable if the piston bushing is inserted into the housing, wherein the cooling channel is preferably sealed by way of sealing elements positioned between the piston bushing and the housing. For example, O-rings are provided in circumferential direction of the axis between the piston bushing and the housing for sealing the cooling channel.

In an advantageous embodiment of the free piston apparatus, it is favorable if the third cooling region is delimited at least in the region of the outlet chamber by a radially outside channel wall and if the cooling medium is able to flow through between the latter and an outer wall of the piston receptacle. The outer wall is in particular an outer wall of the outlet chamber, as mentioned above. The cooling medium flows through a cooling channel section between the outer wall and the channel wall. The channel wall is, e.g., formed separate from the piston receptacle and in particular its housing and, sealing the third cooling region, is connected thereto, respectively. The channel wall advantageously consists of a heat conductive material.

In an advantageous embodiment, the channel wall may be an internal wall arrangement of a housing of the free piston apparatus, in which housing a receiving space for accommodating an energy coupling device is provided.

As already mentioned, the free piston apparatus preferably comprises an energy coupling device which is coupled to the piston device and by way of which energy is able to be decoupled from the piston device or by way of which energy is able to be coupled into the piston device. In particular, there is the possibility of controlling the movement of the piston device by means of the energy coupling device. "Control" is presently to be interpreted as "regulating" also being meant alternatively or in addition. "Controlling" may thus presently be interpreted as "controlling and/or regulating". By the controlling of the energy coupling device, which may be carried out by a control device of the free piston apparatus, the operating point of the free piston apparatus during operation may be adjusted. For this purpose, as needed, energy may be transmitted from the energy coupling device to the piston device or energy may be removed from the piston device by way of the energy coupling device.

The energy coupling device advantageously comprises at least one linear generator. The linear generator has for example a rotor arrangement fixed on the piston device and a stator arrangement. Rotor arrangement and stator arrangement are or comprise in particular magnets and coils, respectively.

Two linear generators with a respective rotor arrangement and a respective stator arrangement may be associated with the piston device. A respective linear generator may for example be positioned laterally next to the piston receptacle and form one of the subsequently mentioned units of the energy coupling device.

The free piston apparatus advantageously comprises a receiving space accommodating the energy coupling device, wherein the channel wall delimiting the at least one third cooling region radially on the outside forms in sections a wall arrangement of the receiving space. This offers the possibility of, for one, removing the heat of the exhaust gas by way of the cooling medium flowing through the at least one third cooling region. A release of heat to the energy coupling device may be avoided. For another, there is also the possibility of removing via the channel wall heat which arises during the operation of the energy coupling device. The functionality of the energy coupling device may thereby be ensured. A reliable and energetically favorable operation of the free piston apparatus is possible.

In particular in combination with the last mentioned advantageous embodiment, it is advantageous if the energy coupling device is positioned laterally next to the piston receptacle, wherein the energy coupling device is arranged in sections laterally next to the at least one third cooling region. This offers the possibility, for example, of a compact structural shape of the free piston apparatus.

The energy coupling device may comprise a first unit and a second unit which each are positioned laterally next to the piston receptacle and a respective third cooling region, wherein the piston receptacle and the third cooling regions are arranged between the units of the energy coupling device. For compensating the moved massed and moments, it is favorable if the energy coupling device comprises two units, of which each, for example as mentioned above, is formed by a linear generator. The piston receptacle and a respective third cooling region are positioned between the units. This allows for a compact structural shape of the free piston apparatus with at the same time an effective cooling of the piston receptacle, in order to avoid an excessive heating of the units of the energy coupling device.

In the wall arrangement may be formed radial feedthroughs for an ignition device and/or an injection device, by way of which the at least one line for electrical energy and/or a fuel are guidable to the combustion chamber, wherein the cooling medium is able to flow around the at least one line or feedthrough, in particular at the second cooling region. For example, the cooling channel at the second cooling region is an annular channel in which the cooling medium flows around at least one radially running feedthrough for the conduit.

It proves to be favorable if the second cooling region is arranged axially between the at least one outlet opening and the at least one inlet opening and if the cooling channel comprises a fourth cooling region which is arranged on a side of the at least one inlet opening opposite the second cooling region. This offers the possibility of effectively cooling the wall arrangement even beyond the at least one inlet opening. The cooling channel at the fourth cooling region is preferably an annular channel. The fourth cooling region may form a downstream side of the cooling channel.

A housing for suppliable fresh gas which at least partially surrounds the wall arrangement may be arranged axially between the second and the fourth cooling region. Fresh gas accommodated in said housing is able to flow into the combustion chamber via the at least one inlet opening. The housing for fresh gas enables a settling of the fresh gas being supplied, wherein pulsations and vortexes are dampened. This proves to be advantageous with regard to an optimized combustion. The second cooling region and the fourth cooling region are flow-connected to each other, e.g., by way of a fluid conduit, perhaps a hose conduit, which may be guided laterally past the housing.

The piston is favorably movable at least partially over the at least one outlet opening, wherein the latter is at least partially unblockable upon the piston adopting the bottom dead center. In this way, the piston may form a valve body for the at least one outlet opening. A separate valve may be dispensed with. At the bottom dead center of the piston, exhaust gas is able to flow out of the combustion chamber through the at least one outlet opening into the outlet chamber.

The free piston apparatus preferably comprises a further piston device having a piston, wherein the pistons of both piston devices are positioned in opposed piston arrangement, wherein the combustion chamber is formed between the pistons. By way of the opposed piston arrangement, a compensation of the moved masses and moments may preferably be achieved. The piston devices thereby oscillate opposite to each other in the piston receptacle. The combustion chamber is formed variable in size between the pistons as a result of the opposing movement of the piston devices.

The free piston apparatus may comprise a further spring-back device which is associated with the further piston device. The spring-back device may comprise a gas spring and/or be of mechanical configuration.

An energy coupling device may also be associated with the further piston device, which energy coupling device is preferably positioned laterally next to the piston receptacle. The energy coupling device may comprise a linear generator. For example, two units of the further energy coupling device which in each case are positioned laterally next to the piston receptacle are provided. Each unit may be formed by a linear generator.

The piston of the further piston device is preferably movable at least partially over the at least one inlet opening, wherein the latter is at least partially unblockable upon the piston adopting the bottom dead center. As a result, the piston may form a valve body for the at least one inlet opening. A separate valve may be dispensed with. At the bottom dead center of the piston, fresh gas is able to flow into the combustion chamber through the at least one outlet opening.

The drawing shows an advantageous embodiment of a free piston apparatus in accordance with the present disclosure, which is applied with the reference numeral 10, which in particular forms a free piston motor 12.

The free piston apparatus 10 comprises an outer housing 14 which is presently cuboidal and is configured as flat housing. The housing 14 defines a receiving space 22 between an upper wall 16, a lower wall 18, and a side wall 20.

Figure 3:
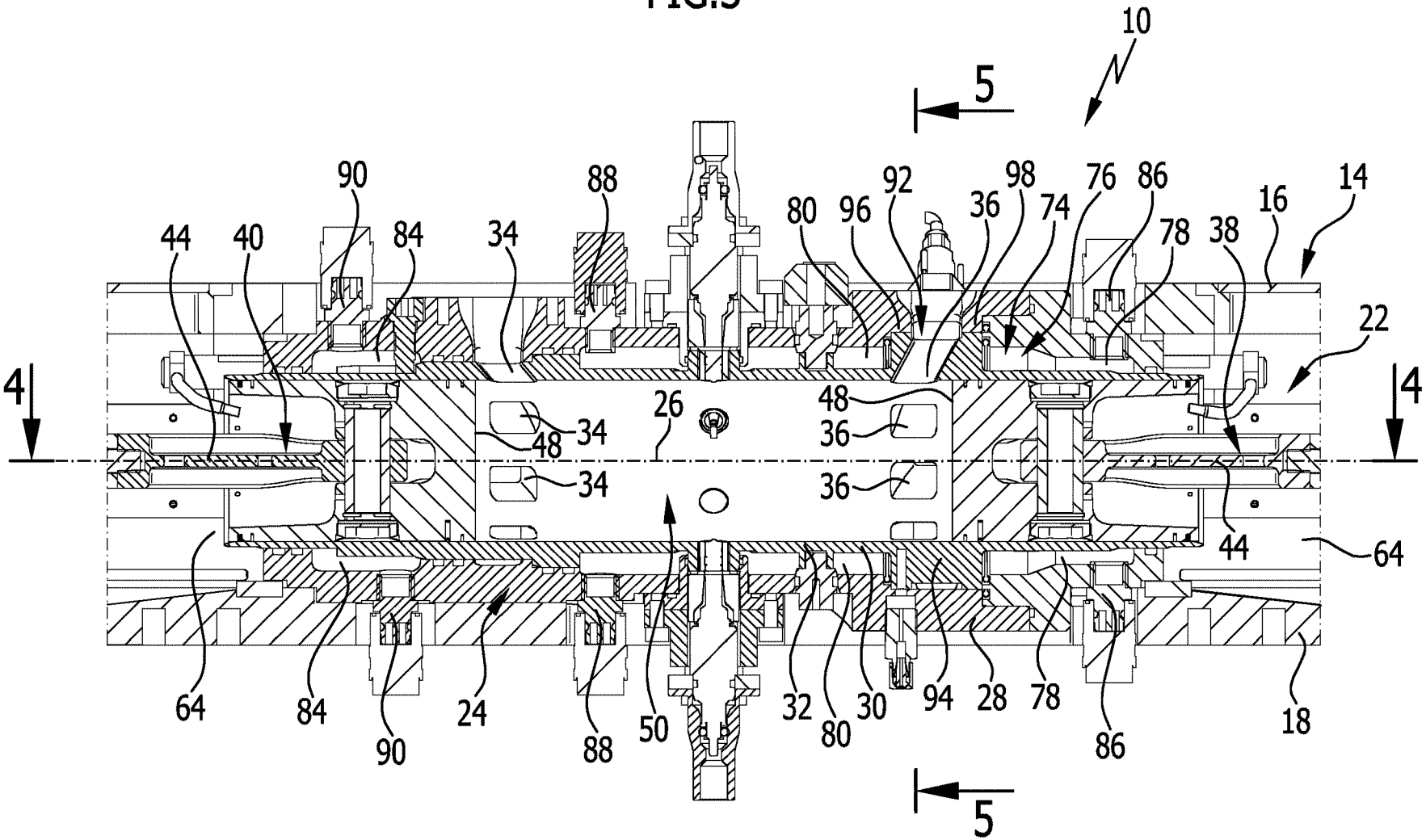
FIG. 3: shows an enlarged depiction of detail A in FIG. 2.
Figure 4:
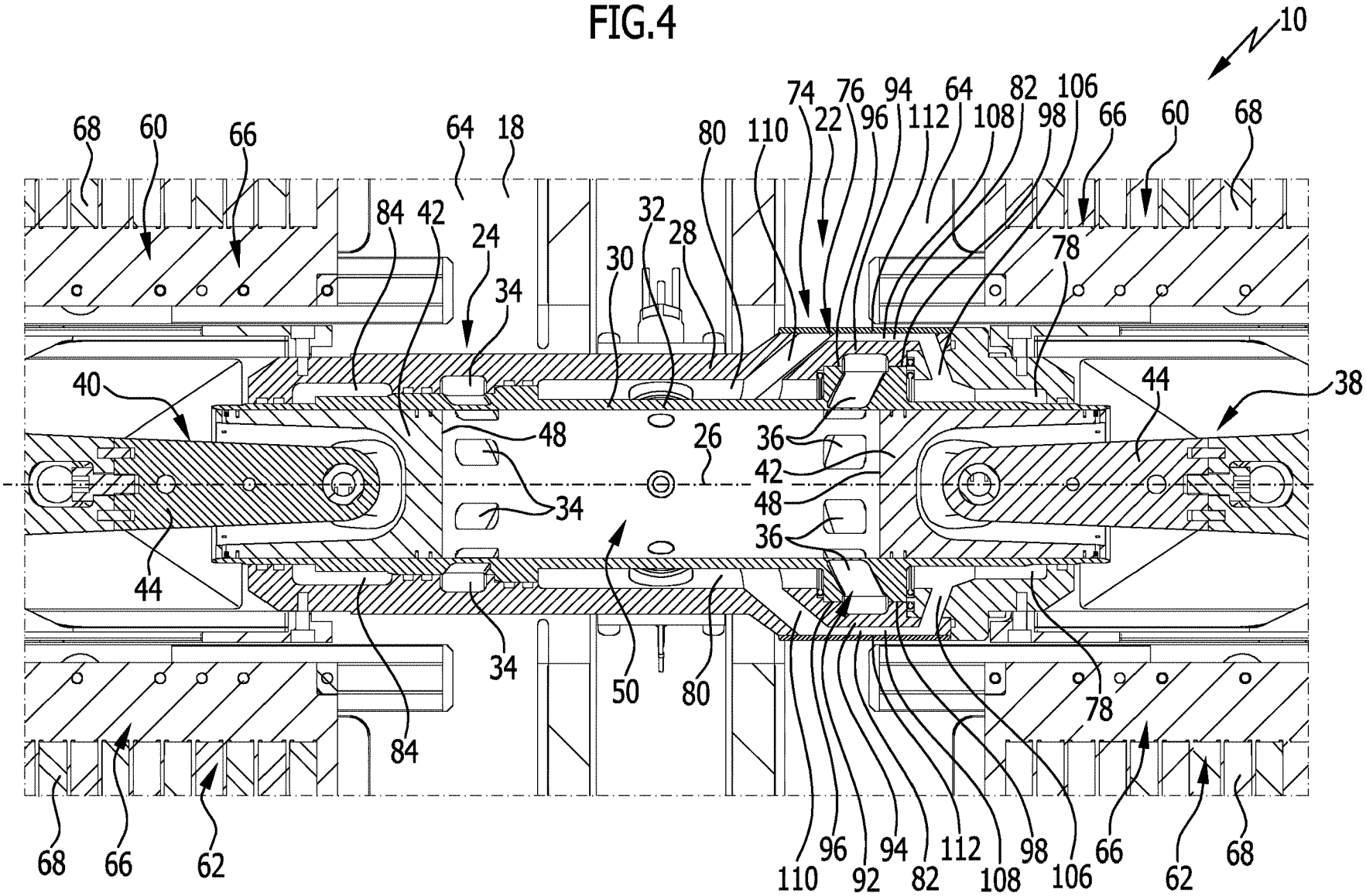
FIG. 4: shows a sectional view along the line 4-4 in FIG. 3.
Figure 5:
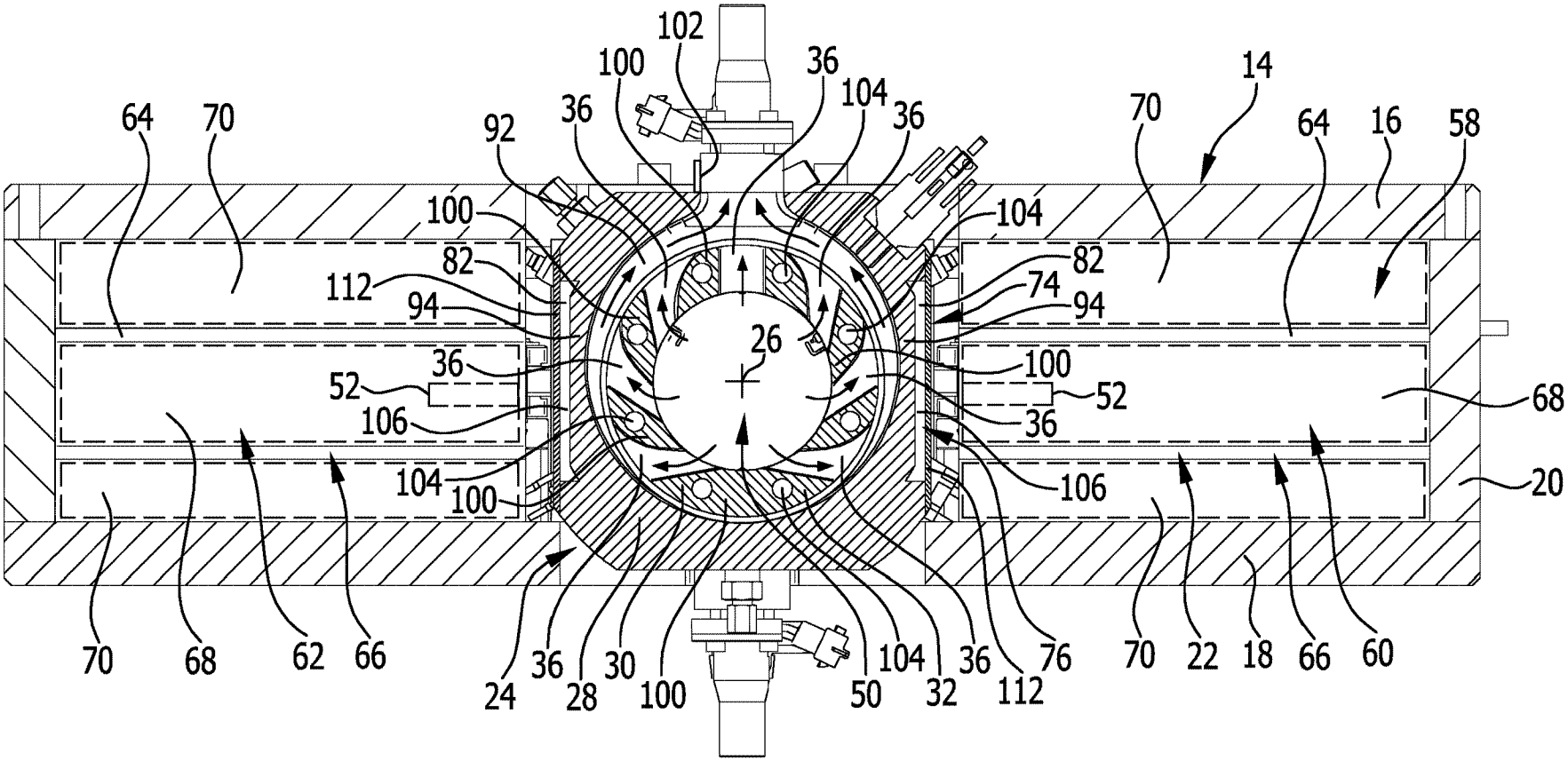
FIG. 5: shows a sectional view along the line 5-5 in FIG. 3.

A piston receptacle 24 is arranged in the housing 14. The piston receptacle 24 is longitudinally extended and defines an axis 26 of the free piston apparatus 10. The piston receptacle 24 has a housing 28 of approximately hollow-cylindrical shape which is divided into individual sections. A piston bushing 30 of the piston receptacle 24 is arranged in the housing 28. The piston bushing 30 is substantially of hollow-cylindrical configuration and is inserted into a middle section of the housing 28 (FIGS. 3 to 5).

Openings are formed in a wall arrangement 32 of the piston bushing 30 and thus the piston receptacle 24. The openings comprise inlet openings 34 on the one hand and outlet openings 36 on the other. Presently, in each case seven inlet openings 34 and outlet openings 36 are present, wherein their respective count may also be different.

The inlet openings 34 are axially spaced apart from the outlet openings 36. "Axial" and "radial" presently refer to the axis 26. "Axial" also includes a direction running parallel to the axis 26.

The respective inlet openings 34 are formed in the wall arrangement 32 at substantially the same position in circumferential direction of the axis 26. The same applies to the outlet openings 36. The inlet openings 34 and the outlet openings 36 are, e.g., of slit-shaped or shaft-shaped configuration.

The free piston apparatus 10 comprises two piston devices 38, 40. The piston devices 38, 40 are arranged in the piston receptacle 24 so as to be axially reciprocable. Each piston device 38, 40 has a (combustion) piston 42, a piston rod 44, and an opposed piston 46. The pistons 42 each comprise a piston face 48 and are positioned in opposed piston arrangement, wherein the piston faces 48 face toward each other.

The piston receptacle 24 comprises a combustion chamber 50 delimited by the wall arrangement 32. The combustion chamber 50 is variable in size and is formed between the piston faces 48 as a result of the opposing movement of the piston devices 38, 40.

The piston rod 44 connects the piston 42 to the opposed piston 46, wherein presently both pistons 42, 46 are tiltingly held on the piston rod 44. However, a rigid connection is also conceivable. Transverse to the axis 26, projections 52 protrude from the piston rod 44 on opposing sides. The projections 52 emerge from the housing 28 and project into the receiving space 22. FIG. 5 schematically shows the contours of the projections 52. The piston rod 44 thereby has an approximately cruciform shape.

The free piston apparatus 10 comprises a spring-back device 54 associated with each piston device 38, 40. The spring-back device 54 presently comprises a gas spring 56 having a spring-back space. The spring-back space is formed by the housing 28 and is arranged thereon at the end side.

Figure 2:
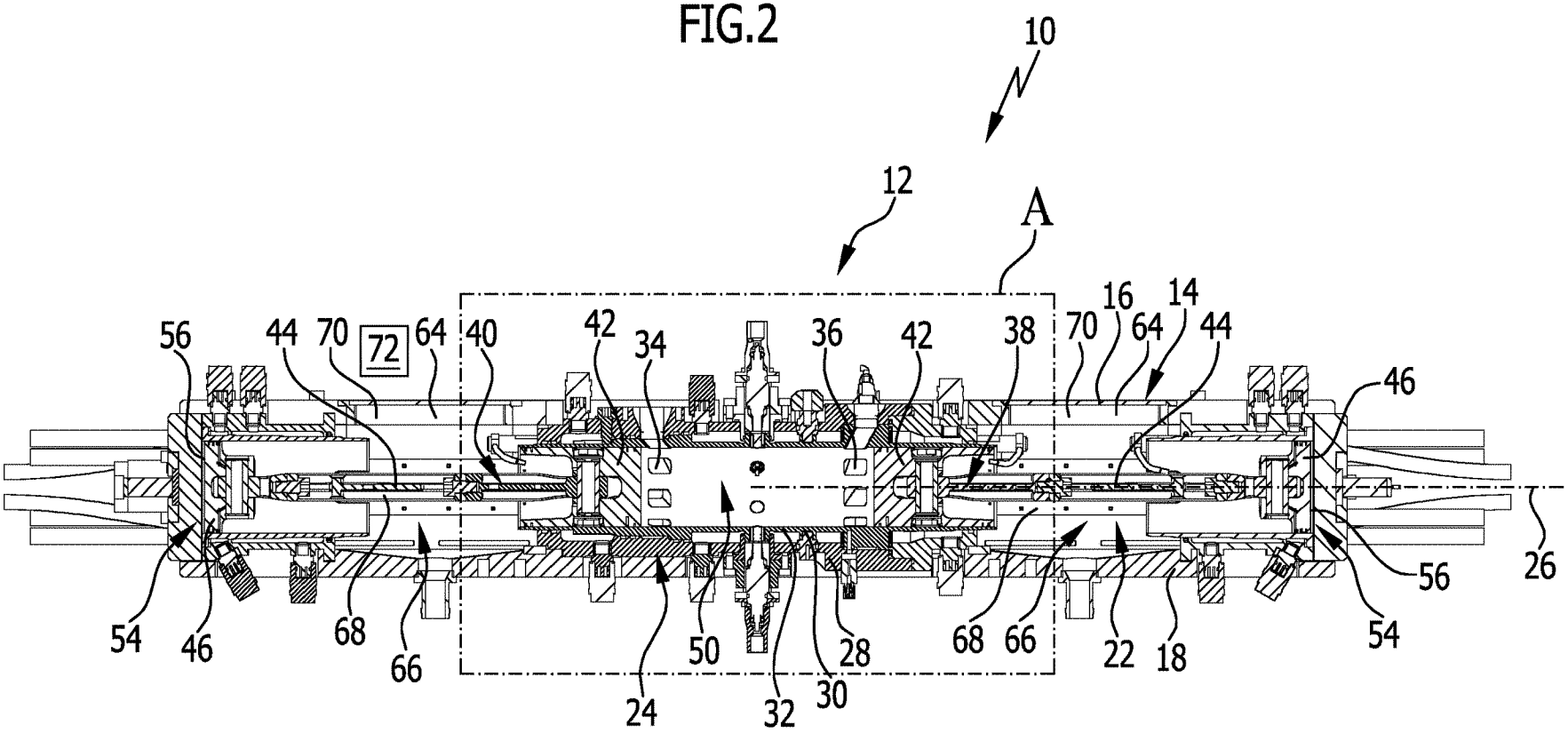
FIG. 2: shows a longitudinal sectional view of the free piston apparatus from FIG. 1.

If the piston devices 38, 40 move from the top dead center to the bottom dead center as a result of the combustion in the combustion chamber 50, then a gas in the spring-back space is compressed by the opposed piston 46 until the piston 42 adopts its bottom dead center (depicted in FIG. 2). Upon the expansion of the gas in the spring-back space, the respective piston device 38, 40 is again displaced in the opposite direction.

The free piston apparatus 10 has two energy coupling devices 58, wherein an energy coupling device 58 is associated with each piston device 38, 40. Each energy coupling device 58 comprises a first unit 60 and a second unit 62. The units 60, 62 are each positioned laterally next to the piston receptacle 24, but on opposing sides thereof. Both units 60, 62 define a common plane in which the piston receptacle 24 is arranged.

The energy coupling devices 58 are accommodated in the receiving space 22 of the housing 14. A spatial region 64 of the receiving space 22 is associated with each unit 60, 62, wherein each spatial region 64 is delimited by the upper wall 16, the lower wall 18, the side wall 20, and the piston receptacle 24.

Each unit 60, 62 is formed by a linear generator 66 with a rotor arrangement 68 and a stator arrangement 70. The rotor arrangement 68 is connected to the piston rod 44 by way of the projection 52 and is displaceably guided in the receiving space 22 parallel to the axis 26. The rotor arrangement 68 comprises magnets. In the drawing, the stator arrangement 70 comprises coils which are not individually depicted and are arranged above and beneath the rotor arrangement 68.

FIG. 5 shows the contours of the rotor arrangements 68 and the stator arrangements 70 of two units 60, 62. Because the piston 42 of the piston device 38 in the drawing adopts the bottom dead center, the sectional view presently does not run through the rotor arrangements 68, which are displaced and cross the sectional plane only upon the (imagined) upward movement of the piston 42.

By way of the energy coupling device 58, there is the possibility of coupling energy into the piston device 38 or 40 and of removing energy therefrom, respectively. This allows for controlling the movement of the piston device 38 or 40 in the operation of the free piston apparatus 10. For this purpose, the energy coupling devices 58 are controllable by a control device 72 (FIG. 2) of the free piston apparatus 10.

The free piston apparatus 10 presently works according to the two stroke method. A combustion in the combustion chamber 50 drives the pistons 42 apart from each other commencing from the top dead center, such that they are axially displaced in the piston bushing 30. The displacement occurs up to a respective bottom dead center of the pistons 42. When the pistons 42 adopt the bottom dead center, then the inlet openings 34 are unblocked by the piston 42 of the piston device 40, and the outlet openings 36 are unblocked by the piston 42 of the piston device 38. This is depicted in FIGS. 2 to 5.

Upon the charge exchange, when the inlet openings 34 and the outlet openings 36 are unblocked, the combustion chamber 50 is scavenged. Fresh gas flows via the inlet openings 34 into the combustion chamber 50. Exhaust gas is able to be removed from the combustion chamber 50 via the outlet openings 36. A uniflow scavenging of the combustion chamber 50 via openings 34, 36 which are axially spaced apart from each other is performed.

"Fresh gas" is presently a gas or a gas mixture (in particular air) for the internal combustion. A fuel may be admixed to the supplied fresh gas. Alternatively or in addition, provision may be made for a fuel to be admixed by way of an injection device to the fresh gas flowing into the combustion chamber 50. The ignition of the charge may occur by means of an ignition device which is controllable by the control device 72. An auto-ignition is also conceivable, depending on the mixture ratio of fresh gas and exhaust gas.

The combustion in the combustion chamber 50 leads to a high temperature of the wall arrangement 32. Due to the uniflow scavenging of the combustion chamber 50, the piston bushing 30 is substantially more thermally stressed axially in the region of the outlet openings 36 than axially in the region of the inlet opening 34. Hot exhaust gas leads to a strong heating in the region of the outlet openings 36, whereas the temperature in the region of the inlet openings 34 is significantly less. A cooling is also achieved there by inflowing cool fresh gas.

For cooling the wall arrangement 32, a cooling device 74 is arranged on the piston receptacle 24. The cooling device 74 has a cooling channel 76.

The cooling channel 76 may be acted upon with a cooling medium, in particular water, in order to remove heat from the piston receptacle 24 at its piston bushing 30 and its housing 28. For conveying the cooling medium, the free piston apparatus may have a pump, which is not depicted in the drawing. In an advantageous implementation of the free piston apparatus 10, a stream of the cooling medium of about five liters to ten liters per minute proves to be advantageous. The temperature of the cooling medium may be about 90° C. for example.

The cooling channel 76 has multiple cooling regions. In particular, one first cooling region 78 is provided, one second cooling region 80, two third cooling regions 82, and one fourth cooling region 84.

The first cooling region 78 is arranged on the side of the outlet openings 36 remote from the inlet openings 34. At the first cooling region 78, the cooling channel 76 forms an annular channel which entirely surrounds the wall arrangement 32 in circumferential direction of the axis 26.

The first cooling region 78 is arranged on the cooling channel 76 on the upstream side. The cooling medium may be supplied via connecting elements 86 connected to the first cooling region 78.

The second cooling region 80 is arranged on the side of the outlet openings 36 facing the inlet openings 34. The cooling regions 78 and 80 are thus positioned on axially opposite sides of the outlet openings 36. The second cooling region 80 is thus arranged between the inlet openings 34 and the outlet openings 36.

At the second cooling region 80, the cooling channel 76 is likewise configured as an annular channel which entirely surrounds the wall arrangement 32 in circumferential direction of the axis 26. Through-openings may be formed in the wall arrangement 32 for conduits connectable thereto. The conduits are in particular for supplying fuel and/or electrical energy to the combustion chamber 50. The cooling medium flowing through the second cooling region 80 may flow around the conduits.

The first cooling region 78 and the second cooling region 80 are flow-connected to each other by way of the third cooling regions 82, which will subsequently be described.

The fourth cooling region 84 is arranged on the side of the inlet openings 34 remote from the outlet openings 36. The cooling regions 80 and 84 are thus positioned axially on opposite sides of the inlet openings 34. At the fourth cooling region 84, the cooling channel 76 forms an annular channel which entirely surrounds the axis 26 in circumferential direction.

The second cooling region 80 and the fourth cooling region 84 are flow-connected to each other by way of fluid conduits not shown in the drawing. Connecting elements 88 at the second cooling region 80 and connecting elements 90 at the fourth cooling region 84 may be provided for connecting the fluid conduits.

The fourth cooling region 84 is arranged on the cooling channel 76 on the downstream side. In this way, the possibility is given to effectively cool the piston receptacle 24 commencing from the first cooling region 78 up to the fourth cooling region 84. In this case, first the particularly hot region of the piston receptacle 24 at and near the outlet openings 36 is cooled with the cooling medium which is still relatively cool. Then, the piston receptacle 24 in the region of the center of the combustion chamber 50 is cooled, and finally the piston receptacle 24 in the region of the inlet openings 34, where a significantly lesser temperature prevails than in the region of the outlet openings 36.

As mentioned, the piston bushing 30 is inserted into the housing 28. The first cooling region 78, the second cooling region 80, and the fourth cooling region 84 are formed radially between the piston bushing 30 and the central section of the housing 28 surrounding said piston bushing 30. Radially inside, the wall arrangement 32 delimits the cooling regions 78, 80, and 84 and, radially outside, the same are delimited by the housing 28.

Sealing elements, in particular O-rings, which are not depicted in the drawing, seal the cooling channel 76 between the piston bushing 30 and the housing 28.

Figure 6:
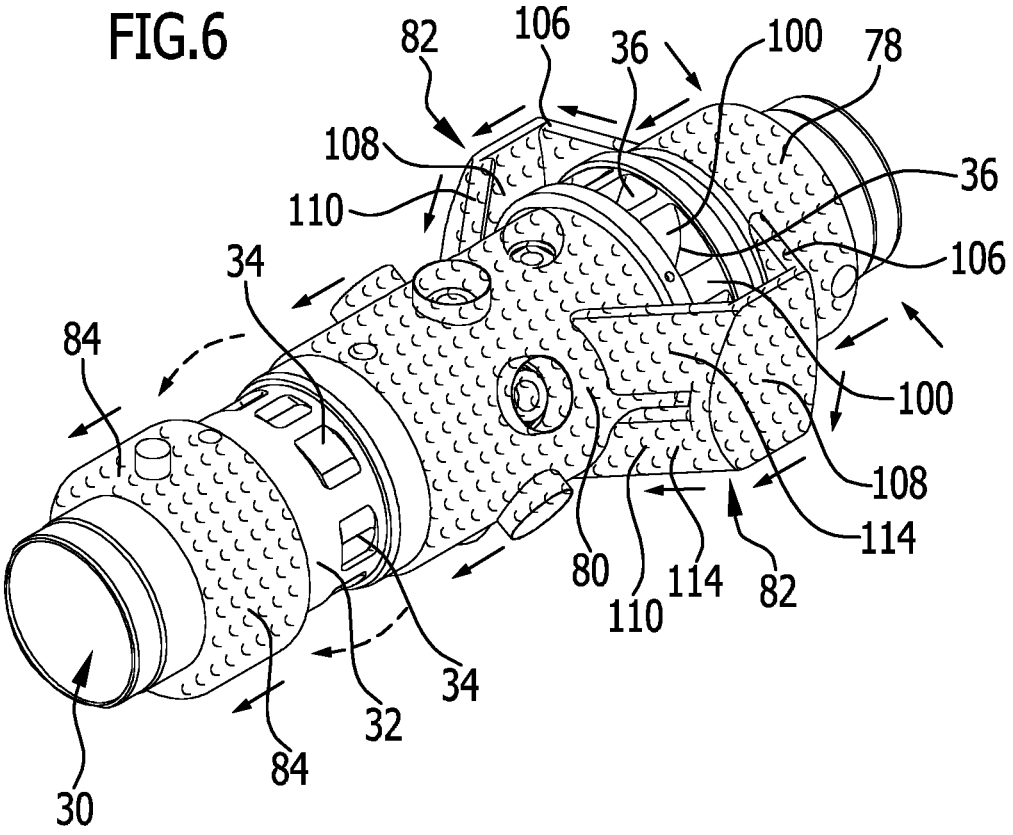
FIG. 6: shows a perspective depiction of a piston bushing of the free piston apparatus from FIG. 1, which is surrounded by a cooling channel, wherein the form of the cooling channel guiding a cooling medium is shown.
Figure 7:
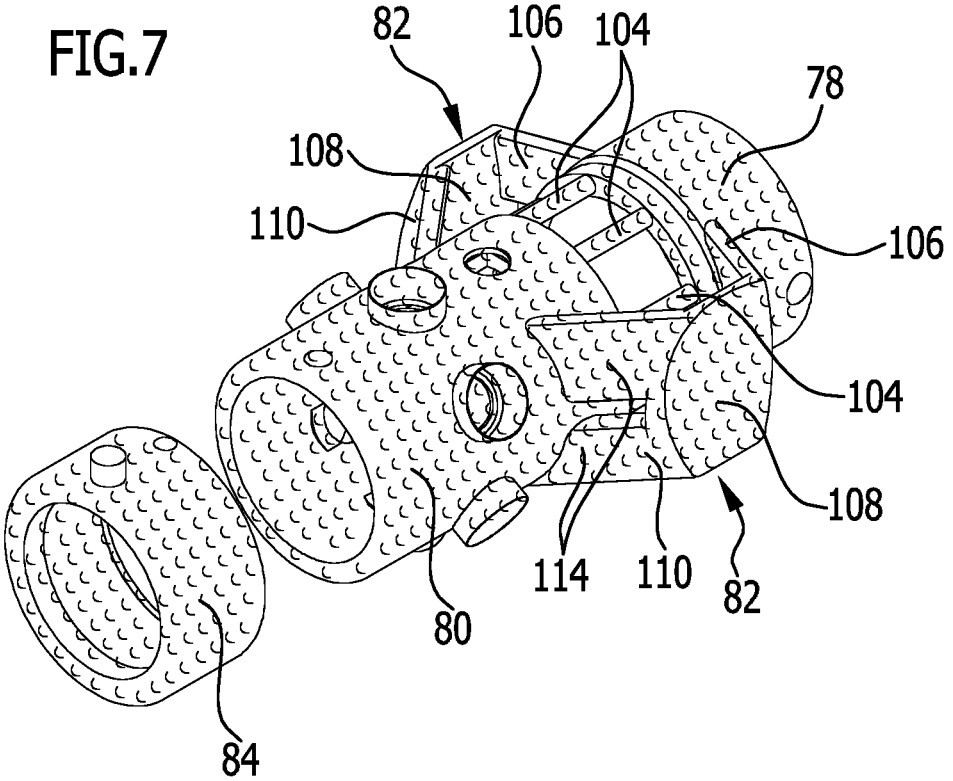
FIG. 7: shows a perspective depiction of the form of the cooling channel guiding the cooling medium from FIG. 6.

FIGS. 6 and 7 show the region of the cooling channel 76 which allows through-flow by cooling medium, which region is provided with a marking for better recognition. The region shown in FIGS. 6 and 7 with the marking (inverted comma) is taken up by the cooling medium.

As a result of that stated above, the cooling channel 76 forms a cooling jacket as a result of the configuration of the cooling regions 78, 80, 84, which cooling jacket axially surrounds the piston bushing 30 in a jacket-like manner except in the region of the inlet openings 34 and the outlet openings 36, and is delimited radially inside by the wall arrangement 32 and radially outside by the housing 28.

The configuration of the piston receptacle 24 and the cooling channel 76 and the improved cooling of the piston receptacle 24 in particular in the region of the outlet openings 36, achievable in accordance with the present disclosure, will subsequently be described. Also the transmission of heat to the units 60, 62 of the energy coupling device 58 may be significantly reduced as subsequently described.

As may be seen in particular from FIGS. 3 to 5, the outlet openings 36 are formed in the wall arrangement 32 in circumferential direction of the axis 26. The piston receptacle 24 forms an outlet chamber 92 arranged on the wall arrangement 32 on the outside. Exhaust gas discharges via the outlet openings 36 into the surrounding outlet chamber 92. The outlet chamber 92 is delimited radially inside by the wall arrangement 32 and radially outside by an outer wall 94 of the housing 28. Face walls 96 and 98 delimit the outlet chamber 92 in axial direction. The face walls 96, 98 are formed by radial projections of the wall arrangement 32 and of the housing 28, see in particular FIG. 4.

An outlet conduit for exhaust gas, which is not shown in the drawing, is connected to the piston receptacle 24. FIG. 5 shows a connecting element 102 in this regard.

The wall arrangement 32 has wall segments 100 between adjacent outlet openings 36. The wall segments 100 extend in axial direction over the length of the outlet openings 36.

For cooling the wall arrangement 32 at the wall arrangements 100, the cooling channel 76 comprises cooling channel sections 104. The cooling channel sections 104 run axially, wherein at least one cooling channel section 104 runs through each wall segment 100 (FIG. 5). The cooling channel sections 104 provide a flow connection from the first cooling region 78 to the second cooling region 80, which is visible in particular in FIG. 7. Heat may thereby be effectively removed from the particularly hot locations on the wall segments 100.

A further flow connection of the cooling regions 78 and 80 is provided by the two third cooling regions 82. The cooling regions 82 are located opposite each other with respect to the axis 26 and enable a cooling of the piston receptacle 24 on opposing sides. The third cooling regions 82 serve in particular for cooling the piston receptacle 24 axially in the region of the outlet openings 36.

The cooling regions 82 are formed symmetrical with respect to each other, which is why only one of the third cooling regions 82 will be subsequently described.

The third cooling region 82 comprises a first cooling channel section 106, a second cooling channel section 108, and a third cooling channel section 110.

The first cooling channel section 106 forms the flow connection to the first cooling region 78. Subsequent to the cooling region 78, the cooling channel section 106 runs at an incline to the axis 26, wherein it is aligned nearly transverse thereto, however (FIGS. 4 and 6). The first cooling channel section 106 runs along the side of the face wall 98 remote from the outlet chamber 92.

The second cooling channel section 108 is arranged radially outside of the outlet chamber 92, in radial direction laterally next to the outer wall 94 of the outlet chamber 92. The second cooling channel section 108 is delimited radially outside by a channel wall 112. As a result, cooling medium is able to flow through the third cooling region in axial direction at least along the extension of the outlet chamber 92, wherein the cooling region 82 is delimited radially by the outer wall 94 and the channel wall 112.

The second cooling channel section 108 runs axially and is formed on the outside on the housing 28 tangentially with respect to the axis 26. In circumferential direction of the axis 26, the cooling region 82 extends over a part angle at the second cooling channel section 108. The second cooling channel section 108 covers an angle range of about 500 to 600.

Presently, the second cooling channel section 108 is configured as a flat channel, wherein its width transverse to the flow direction is significantly greater than its height in radial direction (FIG. 5). The width of the second cooling channel section 108 is presently more than the diameter of the combustion chamber. As a result, the third cooling region 82 forms at the second cooling channel section 108 a relatively large heat sink, by way of which heat may be effectively removed from the outer wall 94, which heat arises due to the dissipation of the hot exhaust gas through the outlet chamber 92.

The third cooling channel section 110 connects the second cooling channel section 108 to the second cooling region 80. The third cooling channel section 110 is inclined relative to the axis 26 and is presently divided into two paths 114 (FIGS. 6 and 7). The third cooling channel section 110 runs along the side of the face wall 96 remote from the outlet chamber 92.

The cooling channel sections 106 and 110 are also configured as flat channels. Further, they extend in circumferential direction of the axis 26 over the same circumferential angle as the cooling channel section 108.

The provision of the third cooling regions 82 allows for ensuring an effective cooling of the piston receptacle 24, also along the axial extension of the outlet chamber 92. The requirements for selection and adaptation of the materials are reduced and the free piston apparatus 10 is overall more cost-efficient and easier to produce and to operate.

Moreover, it is advantageous for a waste heat to the spatial regions 64 and the linear generators 66 arranged therein to be able to be avoided, as the third cooling regions 82 are arranged between the outlet chamber 92 and the spatial regions 64. The operating temperature of the linear generators 66 will thereby not increase to such an extent that their functionality is impaired (for example as a result of a temperature-related demagnetization).

Instead, it is even possible to absorb and remove waste heat of the linear generators 66 from the cooling medium in the third cooling region 82. For this purpose, it is particularly advantageous for the channel wall 112 to simultaneously form in sections a wall arrangement of the spatial region 64 arranged laterally next to the same. Waste heat of the linear generators 66 may thereby also be removed by means of the cooling device 74, which reduces the requirements for the inner cooling of the linear generators 66.

At the same time, a compact structural shape of the free piston apparatus 10 in flat construction is made possible due to the units 60, 62 arranged laterally next to the piston receptacle 24.

REFERENCE NUMERALS

10 free piston apparatus
12 free piston motor
14 housing
16 upper wall
18 lower wall
20 side wall
22 receiving space
24 piston receptacle
26 axis
28 housing
30 piston bushing
32 wall arrangement
34 inlet opening
36 outlet opening
38 piston device
40 piston device
42 piston
44 piston rod
46 opposed piston
48 piston face
50 combustion chamber
52 projection
54 spring-back device
56 gas spring
58 energy coupling device
60 unit
62 unit
64 spatial region
66 linear generator
68 rotor arrangement
70 stator arrangement
72 control device
74 cooling device
76 cooling channel
78 first cooling region
80 second cooling region
82 third cooling region
84 fourth cooling region
86 connecting element
88 connecting element
90 connecting element
92 outlet chamber
94 outer wall
96 face wall
98 face wall
100 wall segment
102 connecting element
104 cooling channel section
106 cooling channel section
108 cooling channel section
110 cooling channel section
112 channel wall
114 path

The invention claimed is:

1. A free piston apparatus comprising:

a piston receptacle defining an axis, the piston receptacle comprising or forming a combustion chamber delimited by a wall arrangement in which at least one inlet opening for the supply of fresh gas and, spaced apart therefrom in an axial direction, at least one outlet opening for the removal of exhaust gas are formed;

at least one piston device having a piston, the at least one piston device being arranged so as to be reciprocable in the piston receptacle along the axis thereof;

a cooling device arranged on the piston receptacle for cooling the wall arrangement, the cooling device comprising or forming a cooling channel for a cooling medium which is arranged radially outside on the wall arrangement and at least partially surrounds the same in circumferential direction of the axis, which cooling channel has a first cooling region and a second cooling region axially on opposing sides of the at least one outlet opening, wherein:

the piston receptacle comprises or forms an outlet chamber, arranged outside on the wall arrangement, the outlet chamber being delimited radially inside by the wall arrangement and being delimited radially outside by an outer wall of the piston receptacle, with exhaust gas entering the outlet chamber via the at least one outlet opening, the cooling channel has at least one third cooling region which extends at least partially in circumferential direction of the axis and which flow-connects the first cooling region and the second cooling region along the axial extension of the outlet chamber and is positioned at least in sections radially outside of the outlet chamber, and the third cooling region is delimited at least in a region of the outlet chamber radially inside by the outer wall of the piston receptacle and radially outside by a channel wall, with cooling medium flowing in the third cooling region between the outer wall of the piston receptacle and the channel wall.

2. The free piston apparatus according to claim 1, wherein the cooling channel has two third cooling regions which are arranged on the piston receptacle opposite each other with respect to the axis.

3. The free piston apparatus according to claim 1, wherein the at least one third cooling region has an axially running cooling channel section which is arranged radially next to the outer wall.

4. The free piston apparatus according to claim 1, wherein the at least one third cooling region comprises axially next to the outlet chamber a cooling channel section running transverse or inclined to the axis for the flow connection to the first cooling region.

5. The free piston apparatus according to claim 1, wherein the at least one third cooling region comprises axially next to the outlet chamber a cooling channel section running transverse or inclined to the axis for the flow connection to the second cooling region.

6. The free piston apparatus according to claim 1, wherein the cooling channel at the at least one third cooling region is configured as a flat channel at least radially next to the outlet chamber.

7. The free piston apparatus according to claim 1, wherein a width of the cooling channel at the at least one third cooling region is at least approximately equal to the diameter of the combustion chamber, at least radially next to the outlet chamber.

8. The free piston apparatus according to claim 1, wherein the at least one third cooling region covers an angle range of 45° to 60° in circumferential direction of the axis, at least radially next to the outlet chamber.

9. The free piston apparatus according to claim 1, wherein the cooling channel at at least one of the first cooling region and at the second cooling region is an annular channel.

10. The free piston apparatus according to claim 1, wherein in the wall arrangement is formed a plurality of outlet openings via which the combustion chamber opens into the outlet chamber, wherein adjacent outlet openings in circumferential direction of the axis are separated from each other by way of in each case one wall segment of the wall arrangement, and wherein the cooling channel comprises or forms cooling channel sections at least in a part of the wall segments, which cooling channel sections flow-connect the first cooling region to the second cooling region.

11. The free piston apparatus according to claim 10, wherein the cooling channel sections run axially.

12. The free piston apparatus according to claim 10, wherein at least one cooling channel section runs in each wall segment.

13. The free piston apparatus according to claim 1, wherein the first cooling region is arranged on the cooling channel on the upstream side and is arranged on a side of the at least one outlet opening remote from the at least one inlet opening, and wherein the second cooling region is arranged on a side of the at least one outlet opening facing the at least one inlet opening, wherein the cooling medium flows through the first cooling region and the at least one third cooling region to the second cooling region.

14. The free piston apparatus according to claim 1, wherein the piston receptacle has a housing and a piston bushing accommodated thereby, wherein at least one of the first cooling region, the second cooling region, and the outlet chamber are formed radially between the piston bushing and the housing.

15. The free piston apparatus according to claim 1, wherein the outer wall is an outer wall of the housing of the piston receptacle.

16. The free piston apparatus according to claim 1, wherein the free piston apparatus comprises an energy coupling device which is coupled to the piston device and by way of which energy is able to be decoupled from the piston device or by way of which energy is able to be coupled into the piston device.

17. The free piston apparatus according to claim 16, wherein the energy coupling device comprises at least one linear generator.

18. The free piston apparatus according to claim 16, wherein the free piston apparatus comprises a receiving space accommodating the energy coupling device, and wherein the channel wall delimiting the at least one third cooling region radially on the outside forms in sections a wall arrangement of the receiving space.

19. The free piston apparatus according to claim 16, wherein the energy coupling device is positioned laterally next to the piston receptacle, wherein the energy coupling device is arranged in sections laterally next to the at least one third cooling region.

20. The free piston apparatus according to claim 16, wherein the energy coupling device comprises a first unit and a second unit which each are positioned laterally next to the piston receptacle and a respective third cooling region, wherein the piston receptacle and the third cooling regions are arranged between the units of the energy coupling device.

21. The free piston apparatus according to claim 1, wherein the second cooling region is arranged axially between the at least one outlet opening and the at least one inlet opening, and wherein the cooling channel comprises a fourth cooling region which is arranged on a side of the at least one inlet opening opposite the second cooling region.

22. The free piston apparatus according to claim 21, wherein the cooling channel at the fourth cooling region is an annular channel.

23. The free piston apparatus according to claim 1, wherein the piston is movable at least partially over the at least one outlet opening and wherein the latter is at least partially unblockable upon the piston adopting the bottom dead center.

24. The free piston apparatus according to claim 1, wherein the free piston apparatus comprises a further piston device having a piston, wherein the pistons of both piston devices are positioned in opposed piston arrangement, wherein the combustion chamber is formed between the pistons.

25. The free piston apparatus according to claim 24, wherein the piston of the further piston device is movable at least partially over the at least one inlet opening and wherein the latter is at least partially unblockable upon the piston adopting the bottom dead center.

26. A free piston apparatus comprising:

a piston receptacle defining an axis, the piston receptacle comprising or forming a combustion chamber delimited by a wall arrangement in which at least one inlet opening for the supply of fresh gas and, spaced apart therefrom in an axial direction, at least one outlet opening for the removal of exhaust gas are formed;

at least one piston device having a piston, the at least one piston device being arranged so as to be reciprocable in the piston receptacle along the axis thereof;

a cooling device arranged on the piston receptacle for cooling the wall arrangement, the cooling device comprising or forming a cooling channel for a cooling medium which is arranged radially outside on the wall arrangement and at least partially surrounds the same in circumferential direction of the axis, which cooling channel has a first cooling region and a second cooling region axially on opposing sides of the at least one outlet opening, wherein:

the piston receptacle comprises or forms an outlet chamber, arranged outside on the wall arrangement, the outlet chamber being delimited radially inside by the wall arrangement and being delimited radially outside by an outer wall of the piston receptacle, with exhaust gas entering the outlet chamber via the at least one outlet opening;

the cooling channel has at least one third cooling region which extends at least partially in circumferential direction of the axis and which flow-connects the first cooling region and the second cooling region along the axial extension of the outlet chamber and is positioned at least in sections radially outside of the outlet chamber; and a width of the cooling channel at the at least one third cooling region is at least approximately equal to the diameter of the combustion chamber, at least radially next to the outlet chamber.

27. A free piston apparatus comprising:

a piston receptacle defining an axis, the piston receptacle comprising or forming a combustion chamber delimited by a wall arrangement in which at least one inlet opening for the supply of fresh gas and, spaced apart therefrom in an axial direction, at least one outlet opening for the removal of exhaust gas are formed;

at least one piston device having a piston, the at least one piston device being arranged so as to be reciprocable in the piston receptacle along the axis thereof;

a cooling device arranged on the piston receptacle for cooling the wall arrangement, the cooling device comprising or forming a cooling channel for a cooling medium which is arranged radially outside on the wall arrangement and at least partially surrounds the same in circumferential direction of the axis, which cooling channel has a first cooling region and a second cooling region axially on opposing sides of the at least one outlet opening, wherein:

the piston receptacle comprises or forms an outlet chamber, arranged outside on the wall arrangement, the outlet chamber being delimited radially inside by the wall arrangement and being delimited radially outside by an outer wall of the piston receptacle, with exhaust gas entering the outlet chamber via the at least one outlet opening;

the cooling channel has at least one third cooling region which extends at least partially in circumferential direction of the axis and which flow-connects the first cooling region and the second cooling region along the axial extension of the outlet chamber and is positioned at least in sections radially outside of the outlet chamber; and the at least one third cooling region covers an angle range of 45° to 60° in circumferential direction of the axis, at least radially next to the outlet chamber.

28. A free piston apparatus comprising:

a piston receptacle defining an axis, the piston receptacle comprising or forming a combustion chamber delimited by a wall arrangement in which at least one inlet opening for the supply of fresh gas and, spaced apart therefrom in an axial direction, at least one outlet opening for the removal of exhaust gas are formed;

at least one piston device having a piston, the at least one piston device being arranged so as to be reciprocable in the piston receptacle along the axis thereof;

a cooling device arranged on the piston receptacle for cooling the wall arrangement, the cooling device comprising or forming a cooling channel for a cooling medium which is arranged radially outside on the wall arrangement and at least partially surrounds the same in circumferential direction of the axis, which cooling channel has a first cooling region and a second cooling region axially on opposing sides of the at least one outlet opening, wherein:

the piston receptacle comprises or forms an outlet chamber, arranged outside on the wall arrangement, the outlet chamber being delimited radially inside by the wall arrangement and being delimited radially outside by an outer wall of the piston receptacle, with exhaust gas entering the outlet chamber via the at least one outlet opening;

the cooling channel has at least one third cooling region which extends at least partially in circumferential direction of the axis and which flow-connects the first cooling region and the second cooling region along the axial extension of the outlet chamber and is positioned at least in sections radially outside of the outlet chamber; and in the wall arrangement is formed a plurality of outlet openings via which the combustion chamber opens into the outlet chamber, wherein adjacent outlet openings in circumferential direction of the axis are separated from each other by way of in each case one wall segment of the wall arrangement, and wherein the cooling channel comprises or forms cooling channel sections at least in a part of the wall segments, which cooling channel sections flow-connect the first cooling region to the second cooling region.

* * * * *